US011767142B1

(12) United States Patent
Gorski

(10) Patent No.: US 11,767,142 B1
(45) Date of Patent: Sep. 26, 2023

(54) PRODUCT DISPLAY PACKAGE

(71) Applicant: Gregg Gorski, Sun Valley, CA (US)

(72) Inventor: Gregg Gorski, Sun Valley, CA (US)

( * ) Notice: Subject to any disclaimer, the term of this patent is extended or adjusted under 35 U.S.C. 154(b) by 0 days.

(21) Appl. No.: 18/128,458

(22) Filed: Mar. 30, 2023

Related U.S. Application Data

(60) Provisional application No. 63/392,098, filed on Jul. 25, 2022.

(51) Int. Cl.

| | |
|---|---|
| ***B65D 5/42*** | (2006.01) |
| ***B65D 25/54*** | (2006.01) |
| ***B65D 5/50*** | (2006.01) |
| ***B65D 5/02*** | (2006.01) |

(52) U.S. Cl.
CPC ..... *B65D 5/4204* (2013.01); *B65D 5/0254* (2013.01); *B65D 5/4208* (2013.01); *B65D 5/503* (2013.01)

(58) Field of Classification Search
CPC .. B65D 5/4204; B65D 5/0254; B65D 5/4208; B65D 5/503; B65D 73/0042; B65D 73/0085; B65D 75/522
USPC ..... 206/775–778, 780, 782–783, 485, 486
See application file for complete search history.

(56) References Cited

U.S. PATENT DOCUMENTS

| | | | | | |
|---|---|---|---|---|---|
| 4,037,717 | A * | 7/1977 | Roccaforte | B65D 5/5009 | 206/783 |
| 4,126,220 | A * | 11/1978 | Roccaforte | B65D 5/5009 | 206/782 |
| 4,159,765 | A * | 7/1979 | Roccaforte | B65D 5/5009 | 206/782 |
| 5,156,276 | A * | 10/1992 | Lebowitz | B65D 5/4204 | 229/162.1 |
| 5,816,411 | A * | 10/1998 | Smith | B65D 5/46096 | 206/769 |
| 6,640,971 | B2 * | 11/2003 | Acevedo | B65D 5/5014 | 206/521 |

* cited by examiner

*Primary Examiner* — Luan K Bui
(74) *Attorney, Agent, or Firm* — Trojan Law Offices

(57) ABSTRACT

An improved packaging box to display a product therein wherein the packaging box comprises a box portion, a bottom support, and a top support. In conjunction with the box portion, the bottom support and the top support hold a product positioned or centered within the box to form an enticing display for the product, without the need for placing representative indicia on the package to indicate its contents.

17 Claims, 8 Drawing Sheets

PRODUCT DISPLAY PACKAGE

CROSS-REFERENCE TO RELATED APPLICATIONS

This Application claims priority to and benefit of the earlier U.S. Provisional Patent Application No. 63/392,098 filed on Jul. 25, 2022, the content of which is incorporated herein by reference in its entirety.

TECHNICAL FIELD

The present invention relates to display packaging, and more particularly, to a packaging box having functions of packaging and storing a product, a function of hanging a packaging box, and a function of visually displaying the enclosed product while the product is packaged within the box.

BACKGROUND

In general, display packaging is known in the art. While some display packaging show the contents of the packages, these are usually plastic packages with unusual shapes that are difficult to stack and can be difficult to disassemble for recycling.

While some box-type packages have windows to display a product therein, the windows are typically limited in view, and potential purchasers cannot see and inspect the entire contents of a package. This results in consumers frequently opening packages prior to purchase, resulting in lost revenue for producers. Windowed box-type packaging is also frequently aesthetically unappealing.

Therefore, it is an object of the present disclosure to provide a packaging box that allows full view of a product contained therein. A further object is to provide a packaging box that provides an aesthetically pleasing design. Yet another object is to provide a display packaging box that can be inexpensively manufactured, assembled, and recycled after purchase. These and other objects of the disclosure are more fully described in the appended description and drawings.

BRIEF DESCRIPTION OF THE FIGURES

These and other features and advantages of the present disclosure will become appreciated, as the same becomes better understood with reference to the specification, claims and drawings herein.

FIGS. 7A-6B illustrate a perspective front view of other assembly steps wherein top flaps are folded to form the top of the packaging box.

SUMMARY OF THE INVENTION

Figure 1:
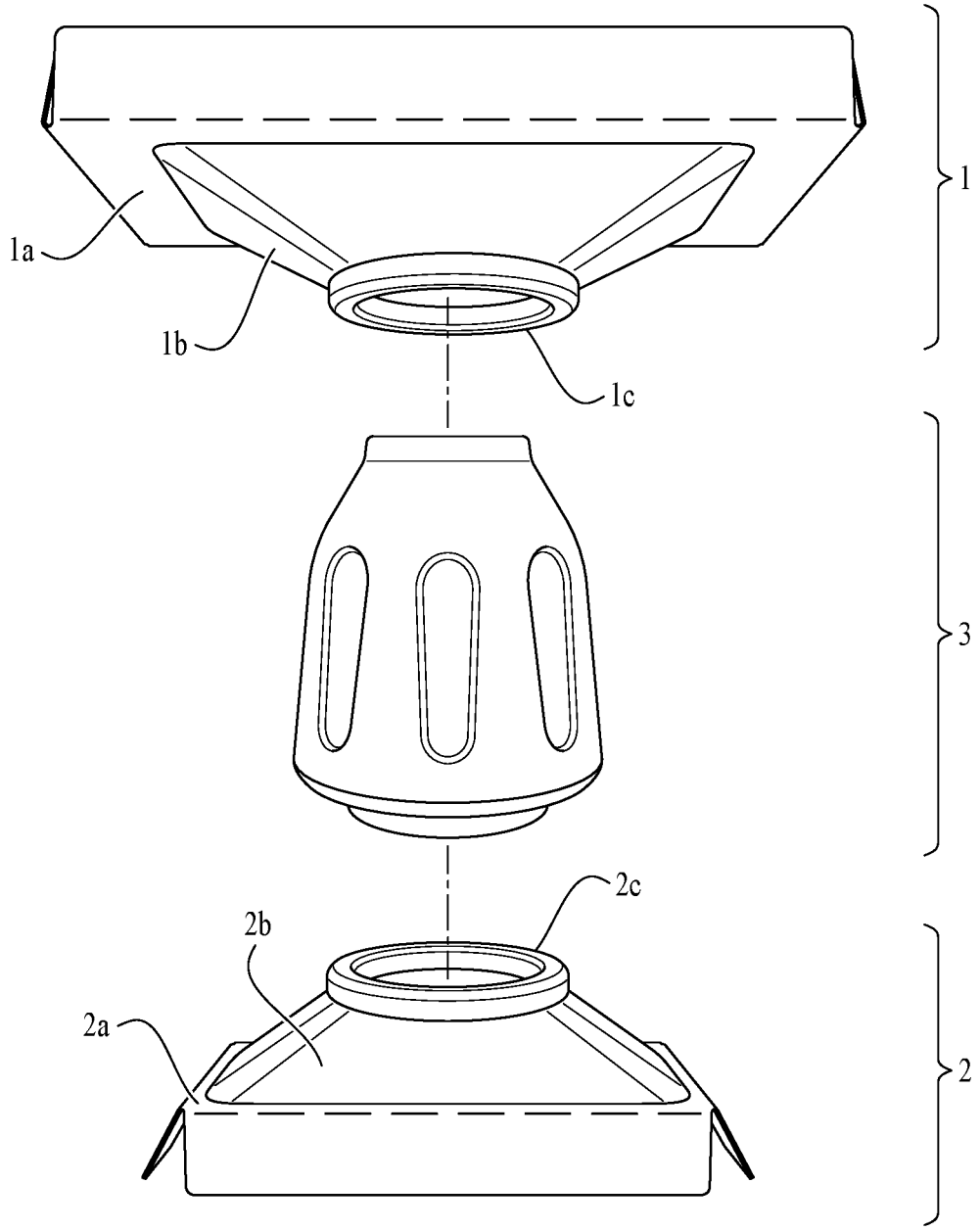
FIG. 1 illustrates a perspective view of two support structures including a top support and a bottom support, and a product to be placed and displayed between the two support structures.

The present invention provides an improved packaging box to display a product therein wherein the packaging box comprises a box portion, a bottom support, and a top support. In conjunction with the box portion, the bottom support and the top support hold a product positioned or centered within the box to form an enticing display for the product, without the need for placing representative indicia on the package to indicate its contents.

The packaging box may comprise a top surface having one or more top flaps, a bottom surface having one or more bottom flaps, a side surface having a plurality of side walls, the plurality of side walls comprise one or more side windows, the one or more top flaps are folded to form the top surface, the one or more bottom flaps are folded to form the bottom surface, the plurality of side walls are folded to form the side surface, wherein the plurality of side walls connect the top surface to the bottom surface to form an inside of the packaging box, wherein the inside of the packaging box is visually displayed through the one or more side windows.

The plurality of side walls may comprise four side walls including a left side wall, a right side wall, a front side wall, and a back side wall. The four top flaps may include a left top flap, a right top flap, a front top flap, and a back top flap, wherein the left top flap is attached to the left side wall, the right top flap is attached to the right side wall, the front top flap is attached to the front side wall, and the back top flap is attached to the back side wall.

The packaging box may further comprise a top support and a bottom support, wherein a product is placed between the top support and the bottom support, wherein the top support is positioned between the four side walls and the top surface, wherein the bottom support is positioned between the four side walls and the bottom surface, wherein the product is placed between the top support and the bottom support, and wherein the product is visually displayed through the one or more side windows.

The top support can be made in a form of a first substantially pyramidical shape with a first apex, and the bottom support can be made in a form of a second substantially pyramidical shape with a second apex, wherein the product is placed between the first apex and the second apex.

The back top flap may comprise a first cut-out portion, the front top flap may comprise a first insertion projection in a form of a carrying handle, wherein the first cut-out portion receives the first insertion projection.

The back top flap may comprise a second insertion projection that extends from a side of the back top flap, and the front top flap may further comprise a second cut-out portion, wherein the second cut-out portion receives the second insertion projection.

The front side wall and the front top flap can be cut to form a third insertion projection, and the second insertion projection may comprise a third cut-out portion, wherein the third cut-out portion receives the third insertion projection.

The first insertion projection in the form of the carrying handle may comprise a hanger insertion cut-out.

The one or more side windows may comprise a front side window and a back side window. The front side wall may be cut and folded through first predetermined lines to form the front side window. The back side wall may be cut and folded through second predetermined lines to form the back side window.

The four side walls may be rectangular in shape. The front side window can be rectangular in shape and can be enclosed within sides of the front side wall. The back side window can be rectangular in shape and can be enclosed within sides of the back side wall. The front side window may comprise a first left flap and a first right flap. The back side window may comprise a second left flap and a second right flap. The first left flap and the first right flap of the front side window can be folded toward the inside of the packaging box to form the front side window. The second left flap and the second right flap of the back side window can be folded toward the inside of the packaging box to form the back side window.

The first apex may comprise a first ring shaped portion, and the second apex may comprise a second ring shaped portion, wherein the product is placed between the first ring shaped portion and the second ring shaped portion.

The top surface, the bottom surface, and the side surface can be made from a single sheet of a material, wherein the single sheet is cut and folded through predetermined lines to form the packaging box.

The present invention is further related to a method of assembling the packaging box, comprising forming sides of the packaging box by the four side walls to make a square tube, folding the first left flap and the first right flap of the front side window toward the inside of the packaging box to open the front side window, folding the second left flap and the second right flap of the back side window toward the inside of the packaging box to open the back side window, inserting the bottom support through a bottom opening of the packaging box, folding the one or more bottom flaps to close the bottom opening of the packaging box, placing the product on the first apex of the bottom support, inserting the top support through a top opening of the packaging box to display the product being placed between the first apex of the bottom support and the second apex of the top support, folding the four top flaps to close the top opening of the packaging box.

The packaging box may further comprise a product retention bracket, the product retention bracket comprises a base portion, a first engaging flap, and a second engaging flap; the base portion is attached to the first apex of the top support; the first engaging flap and the second engaging flap are attached to the base portion; the first engaging flap and the second engaging flap are folded relative to the base portion to be inserted through an opening of the product, thereby, attaching the product to the top support through the product retention bracket; wherein the top support remains attached to the product while the top support is being removed from the top of the packaging box.

According to another implementation of the present invention, a packaging box may comprise: a top surface having four top flaps including a left top flap, a right top flap, a front top flap, and a back top flap; a bottom surface having one or more bottom flaps; a side surface comprising four side walls including a left side wall, a right side wall, a front side wall, and a back side wall; the four side walls comprise one or more side windows; the four top flaps are folded to form the top surface; the one or more bottom flaps are folded to form the bottom surface; the four side walls are folded to form the side surface; the four side walls connect the top surface to the bottom surface to form an inside of the packaging box; wherein the left top flap is attached to the left side wall, the right top flap is attached to the right side wall, the front top flap is attached to the front side wall, and the back top flap is attached to the back side wall; the packaging box further comprising a top support made in a form of a first substantially pyramidical shape with a first apex, and a bottom support made in a form of a second substantially pyramidical shape with a second apex; a product positioned between the top support and the bottom support; wherein the top support is positioned between the four side walls and the top surface; wherein the bottom support is positioned between the four side walls and the bottom surface; and wherein the product is visually displayed through the one or more side windows while positioned between the first apex and the second apex.

The packaging box according to the other implementation of the present invention, wherein the back top flap comprises a first cut-out portion; the front top flap comprises a first insertion projection in a form of a carrying handle; and the first cut-out portion receives the first insertion projection.

The packaging box according to the other implementation of the present invention, wherein the back top flap comprises a second insertion projection that extends from a side of the back top flap; the front top flap further comprises a second cut-out portion; and the second cut-out portion receives the second insertion projection.

The packaging box according to the other implementation of the present invention, wherein the front side wall and the front top flap are cut to form a third insertion projection; the second insertion projection comprises a third cut-out portion; and the third cut-out portion receives the third insertion projection.

The packaging box according to the other implementation of the present invention, wherein the first insertion projection in the form of the carrying handle comprises a hanger insertion cut-out.

The packaging box according to the other implementation of the present invention, wherein the one or more side windows comprises a front side window and a back side window; the front side wall is cut and folded through first predetermined lines to form the front side window; and the back side wall is cut and folded through second predetermined lines to form the back side window.

The packaging box according to the other implementation of the present invention, wherein the first apex comprises a first ring shaped portion; the second apex comprises a second ring shaped portion; and wherein the product is placed between the first ring shaped portion and the second ring shaped portion. The packaging box may further comprise a product retention bracket, the product retention bracket comprises a base portion, a first engaging flap, and a second engaging flap; the base portion is attached to the first apex of the top support; the first engaging flap and the second engaging flap are attached to the base portion; the first engaging flap and the second engaging flap are folded relative to the base portion to be inserted through an opening of the product, thereby, attaching the product to the top support through the product retention bracket; and wherein the top support remains attached to the product while the top support is being removed from the top of the packaging box.

DETAILED DESCRIPTION

The present invention will be described with reference to the accompanying drawings, in which exemplary embodiments of the present invention are shown. It is noted that, in the accompanying drawings, the same components are denoted by the same reference numerals as possible. In addition, detailed descriptions of well-known functions and configurations that may obscure the subject matter of the present invention will be omitted.

An embodiment of the present invention provides an improved packaging box to display a product therein wherein the packaging box comprises a box portion, a bottom support, and a top support. In conjunction with the box portion, the bottom support and the top support hold a product positioned or centered within the package to form an enticing display for the product, without the need for placing representative indicia on the package to indicate its contents.

Referring to FIG. 1, in the illustrated implementation, a top support 1 and a bottom support 2 each comprises a substantially pyramidal shape, wherein the substantially pyramidal portions (1*b*, 2*b*) of the supports are attached to base portions (1*a*, 2*a*) which hold the support structures (1, 2) within the box, and wherein the product 3 is positioned between the bottom support and the top support. In other implementations, conical shapes or other shapes having a small area engaging the product 3 are contemplated. At the apex of each of the bottom support and top support, a product engaging feature is provided for fixing the product relative to the box. In the illustrated implementation, the product engaging feature on the bottom support and top support each comprises a ring-shaped portion (2*c*, 1*c*), such as indented rings, into which the product seats. In other implementations, the engaging features may be convex rather than concave, and may be of any other preferred shape effective for holding the product. One benefit of the illustrated ring-shaped engaging features is that the product may be rotated relative to the box, bottom support, and top support while still installed and secured therein.

According to FIG. 1, with the product seated on the bottom support, the top support may be installed on the product. The engaging feature of the top and the bottom supports can be ring-shaped portions with a same size or can be made in different sizes. For example, the bottom support may comprise a smaller ring-shaped engaging feature, or a larger ring-shaped engaging feature, although any suitable configuration is contemplated that holds the product securely.

In order to enhance the visual aesthetic of the packaging box, and to reveal as much of the product as possible for viewing, the bottom support and the top support can be roughly pyramidal in shape, thereby contacting the product as little as possible, while holding it centered in all orthogonal directions relative to the box portion. Furthermore, the exterior of the packaging box can be substantially rectangularly cuboidal, thereby visually emphasizing the presentation of the product as it is held between two pyramidal shapes.

Figure 2:
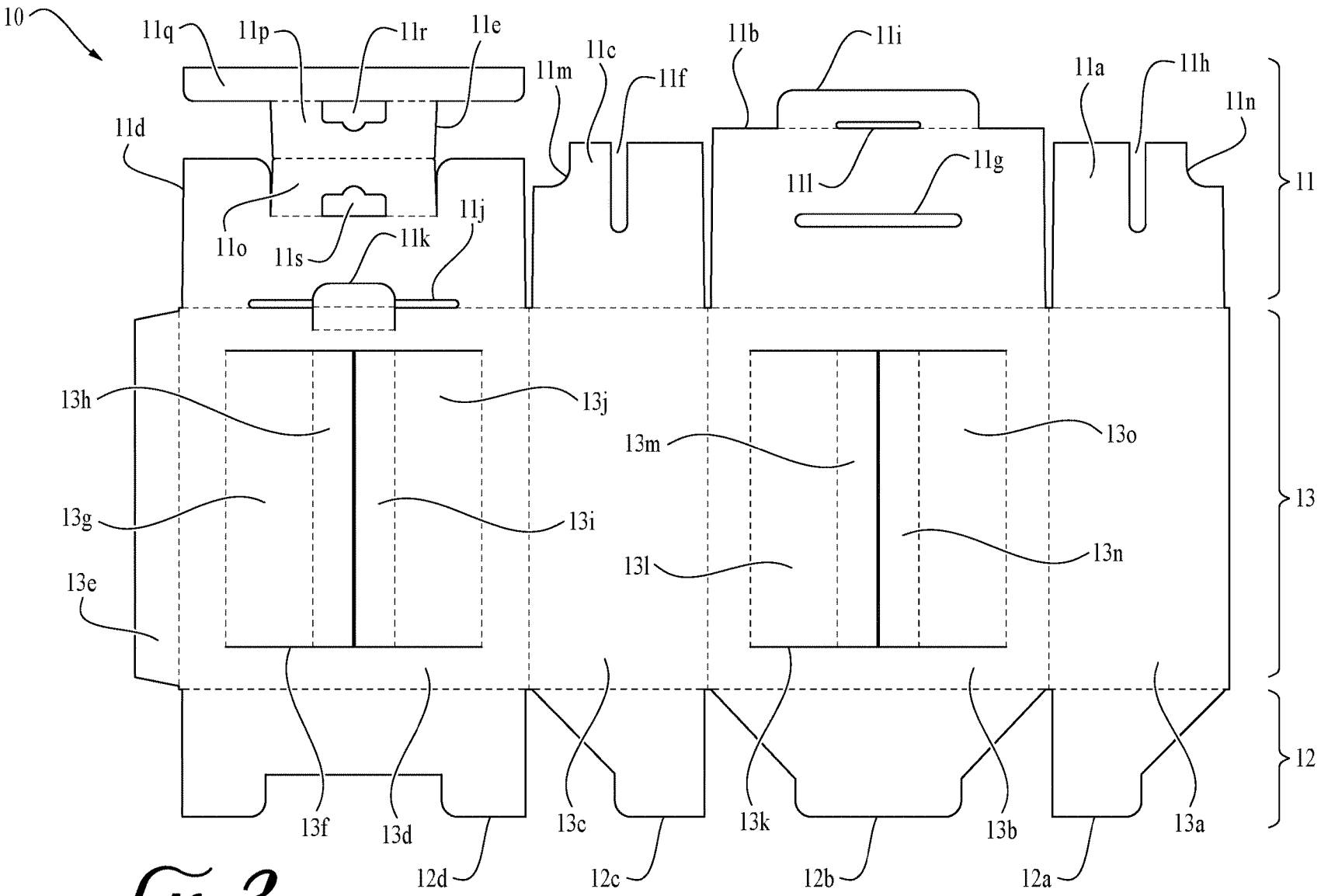
FIG. 2 illustrates a top plan view of an unfolded box component of the packaging box.

FIG. 2, illustrates a single sheet of a material, from which the box portion may be created. The single sheet of a material may be stamped or otherwise created from a larger piece of two-dimensional sheet of material. The single sheet of material can be cut and folded multiple times over predetermined lines to form the box 10. In FIG. 2, the solid lines illustrate the cut lines, and the dashed lines illustrate the fold lines for forming a three-dimensional box from the single sheet of the material.

Figure 3B:
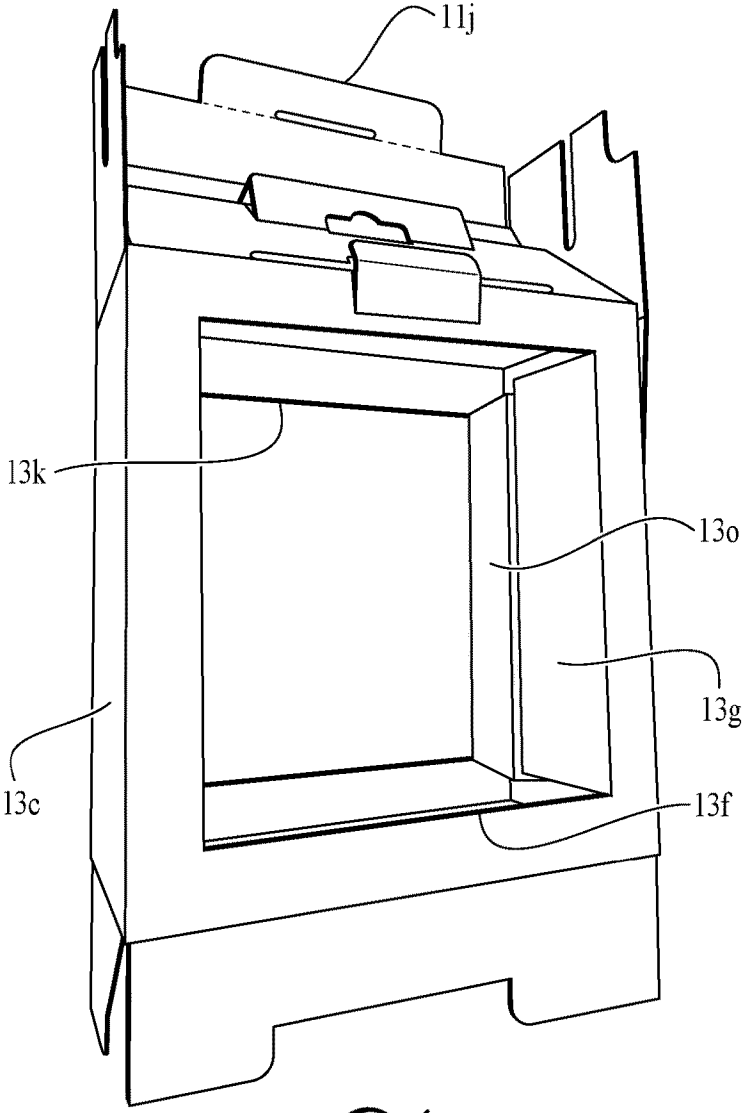
FIG. 3B illustrates a perspective front view of the box component after being folded in an assembly step.
Figure 3A:
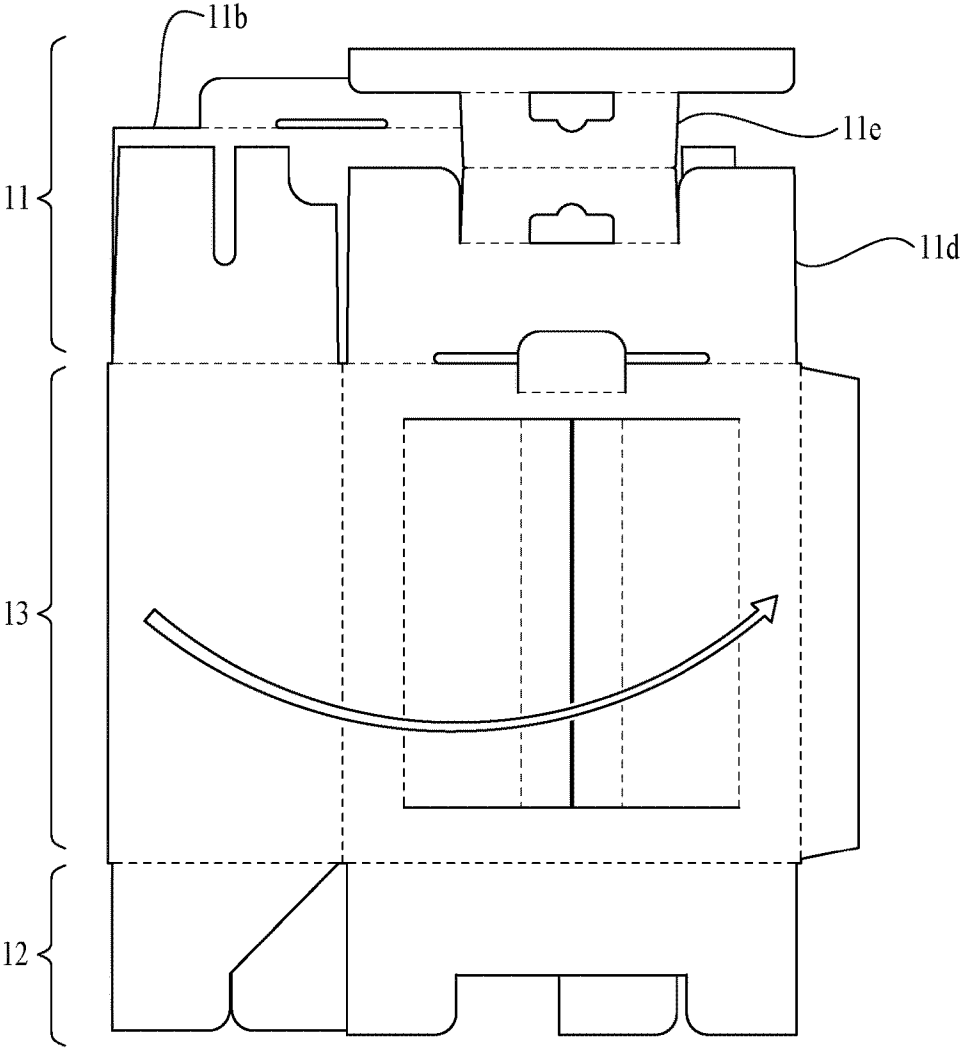
FIG. 3A illustrates a top plan view of the box component folded in an assembly step.

According to an embodiment of the invention as illustrated in FIG. 2, the box 10 comprises a top surface 11 having four top flaps (right top flap 11*a*, back top flap 11*b*, left top flap 11*c*, front top flap 11*d*), a bottom surface 12 having four bottom flaps (12*a*, 12*b*, 12*c*, 12*d*), and side surface 13 having four side walls (right side wall 13*a*, back side wall 13*b*, left side wall 13*c*, front side wall 13*d*) and an attachment wall 13*e*, wherein the side walls are positioned between the top flaps and bottom flaps as illustrated in FIG. 2, and wherein two edges of the side walls, as further shown by the arrow in FIGS. 3A-3B, are folded and attached to each other to create a square shaped tube.

According to an embodiment of the invention as illustrated in FIG. 2, the four top flaps (11*a*, 11*b*, 11*c*, 11*d*) are folded toward the top surface of the box, over the dashed lines between the top flaps and side walls, to close the top of the box 10.

According to FIG. 2, the top flap 11*d* comprises a carrying handle 11*e* including portions (11*o*, 11*p*, 11*q*) wherein the portions are folded through the dashed lines to form the handle 11*e*. Portion 11*p* and 11*o* are folded over the dashed line therebetween toward each other to form a first insertion projection in the carrying handle. The carrying handle 11*e* further comprises hanger insertion cut-outs/holes 11*r* and 11*s* to receive a hanger therethrough. The flap 11*d* further comprises a cut-out portion 11*j* (second cut-out portion 11*j*) which receives insertion projection 11*i* (second insertion projection 11*i*) to close/secure the top of the box 10.

According to FIG. 2, the back top flap 11*b* comprises a first cut-out portion 11*g* to receive the first insertion projection of the carrying handle 11*e* therethrough. The top flap 11*b* further comprises the second insertion projection 11*i* that extends from the side of the back top flap 11*b*. The second insertion projection 11*i* includes the third cut-out portion 11*l* that receives the third insertion projection 11*k* to further close/secure the top of the box 10. The third insertion projection 11*k* is made by cutting and folding through predetermined lines over the surface of the side wall 13*d* and the top flap 11*d*.

According to FIG. 2, the left top flap 11*c* and the right top flap 11*a* comprise the cut-outs 11*f* and 11*h* to receive the first insertion projection of the carrying handle 11*e* therethrough. The top flaps 11*c* and 11*a* further comprise curved cut-outs 11*m* and 11*n* to allow the second insertion projection 11*i* to be inserted through the cut-out 11*j* to further close/secure the top of the box 10.

According to an embodiment of the invention as illustrated in FIG. 2, the bottom surface 11 comprises four bottom flaps (12*a*, 12*b*, 12*c*, 12*d*), wherein bottom flaps are folded together to close/seal the bottom surface of the box 10.

According to an embodiment of the invention as illustrated in FIG. 2, the side surface 13 comprises four side walls (right side wall 13*a*, back side wall 13*b*, left side wall 13*c*, front side wall 13*d*) and an attachment wall 13*e* that extends from a side of the side wall 13*d*. As illustrated in FIG. 2, the side wall 13*a* is further attached to the side wall 13*b*, the side wall 13*b* is attached to the side wall 13*c*, the side wall 13*c* is further attached to the side wall 13*d*, and the side wall 13*d* is further attached to the attachment wall 13*f*, wherein the side walls and the attachment wall are folded over the dashed lines therebetween, and the attachment wall 13*e* is attached to a side of the wall 13*a* to form the side surface of the box 10 and make a square tube.

Figure 7B:
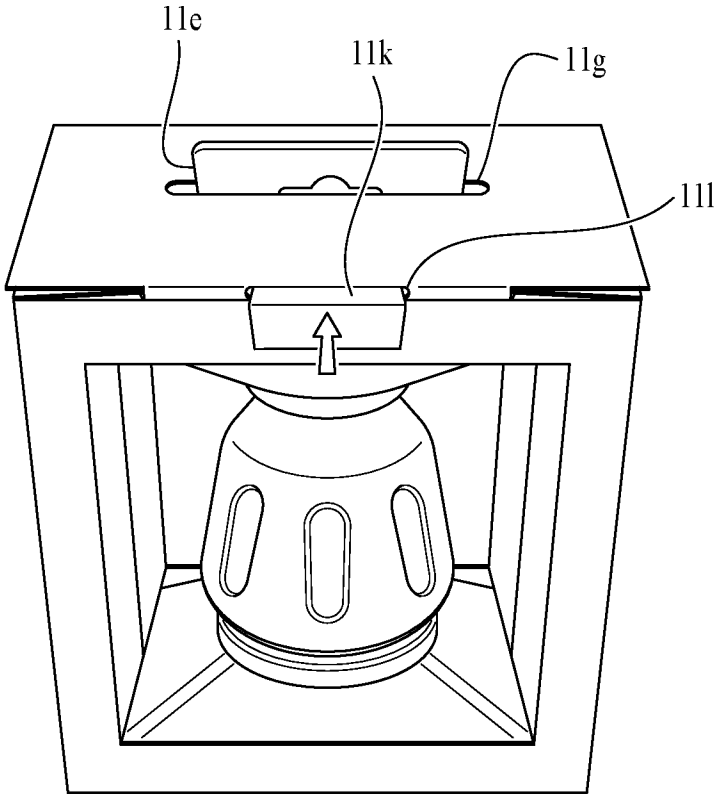

According to an embodiment of the invention as illustrated in FIG. 2, two of the side walls (back side wall 13*b*, front side wall 13*d*) comprise openings/windows (back side window 13*k*, front side window 13*f*) that are formed within the side walls 13*b* and 13*d* by cutting through the predetermined solid lines and folding through the predetermined dashed lines as illustrated in FIG. 2 to make openings/windows on side walls 13*k* and 13*f*, wherein the product positioned inside the box between supports 1 and 2 can be seen through the back side window 13*k* and the front side window 13*f*. The finished packaging box in FIG. 7B shows the positioning of the product 3 inside the packaging box.

According to an embodiment of the invention as illustrated in FIG. 2, the front side window 13*f* is formed by folding flaps 13*h* and 13*i* over the corresponding dashed lines toward the inside of the box 10 relative to flaps 13*g* and 13*j* respectively by 90 degrees, and then folding flaps 13*g* and 13*j* over the corresponding dashed lines toward the inside of the box 10 relative to the side wall 13*d* by 90 degrees, to form the front side opening/window 13*f* in the front side wall 13*d*. Similarly, the window 13*k* is formed by folding flaps 13*m* and 13*n* over the corresponding dashed lines toward the inside of the box 10 relative to flaps 13*l* and 13*o* respectively by 90 degrees, and then folding flaps 13*l* and 13*o* over the corresponding dashed lines toward the inside of the box 10 relative to the back side wall 13*b* by 90 degrees, to form the back side opening/window 13*k* in the back side wall 13*b*.

FIG. 3A illustrates a folding process step of forming the box 10 from the single sheet of the material as shown in FIG. 2, wherein two edges of the side walls, as shown by the arrow, are folded and attached to each other through the attachment wall 13*e* to create a square shaped tube as shown in FIG. 3B. According to FIG. 3A, the four side walls (13*a*, 13*b*, 13*c*, 13*d*) and the attachment wall 13*e* are folded over the corresponding dashed lines, and the attachment wall 13*e* is attached to a side of the wall 13*a* to form a square shaped tube for the side surface of the box 10. For example, the attachment wall 13*e* can be glued to the side of the wall 13*a* to form a square shaped tube for the side surface of the box 10.

FIG. 3B illustrates another folding process step of the box 10, wherein the front side window 13*f* and the back side window 13*k* are formed. In this folding process, the front side window 13*f* is formed by folding flaps 13*h* and 13*i* over the corresponding dashed lines toward the inside of the box 10 relative to flaps 13*g* and 13*j* respectively by 90 degrees, and then by folding flaps 13*g* and 13*j* over the corresponding dashed lines toward the inside of the box 10 relative to the front side wall 13*d* by 90 degrees, to form the front side opening/window 13*f* in the front side wall 13*d*. Similarly, the back side window 13*k* is formed by folding flaps 13*m* and 13*n* over the corresponding dashed lines toward the inside of the box 10 relative to flaps 13*l* and 13*o* respectively by 90 degrees, and then by folding flaps 13*l* and 13*o* over the corresponding dashed lines toward the inside of the box 10 relative to the back side wall 13*b* by 90 degrees, to form the back side opening/window 13*k* in the side wall 13*b*. The windows 13*f* and 13*k* are further illustrated in FIGS. 4B and 5C in an open configuration wherein flaps 13*j* and 13*l* are coupled to each other through flaps 13*i* and 13*m* (flaps 13*i* and 13*m* cannot be seen in this view), and flaps 13*g* and 13*o* are coupled to each other through flaps 13*h* and 13*n* (flaps 13*h* and 13*n* cannot be seen in this view).

Figure 4B:
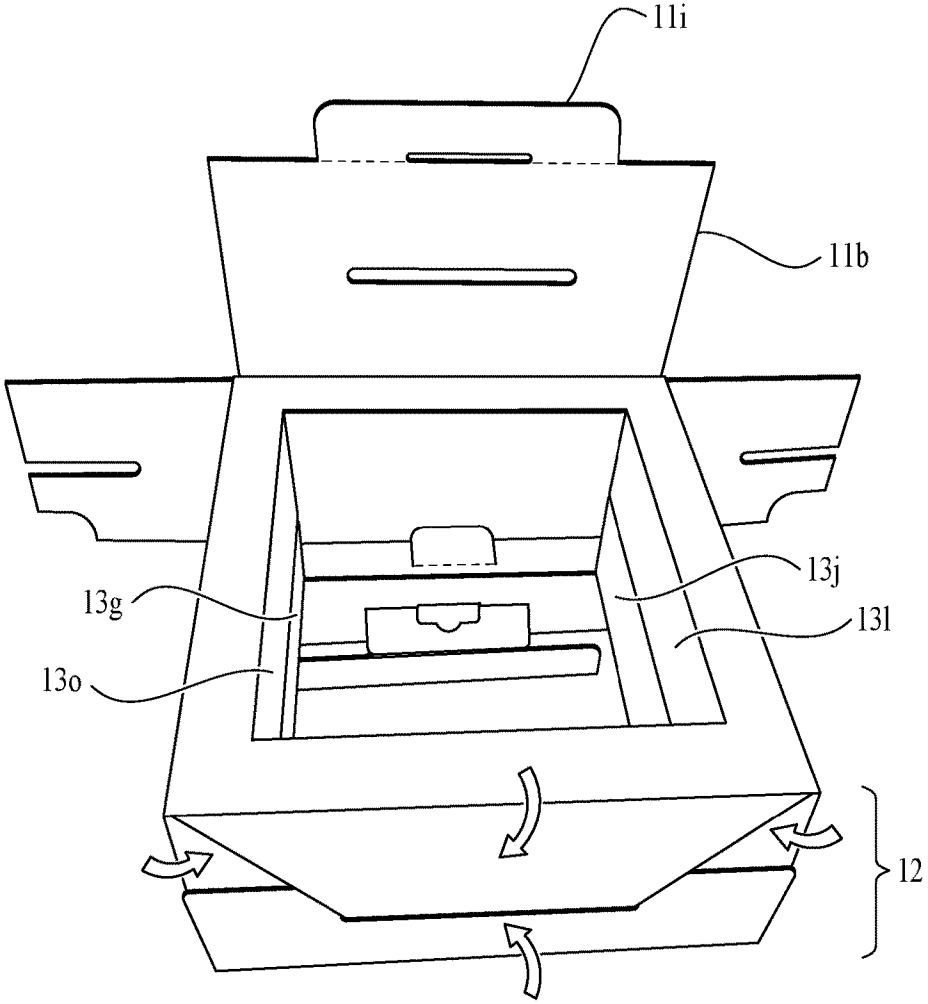
FIG. 4B illustrates a perspective back view of another assembly step wherein bottom flaps are folded to close the bottom of the packaging box.
Figure 4A:
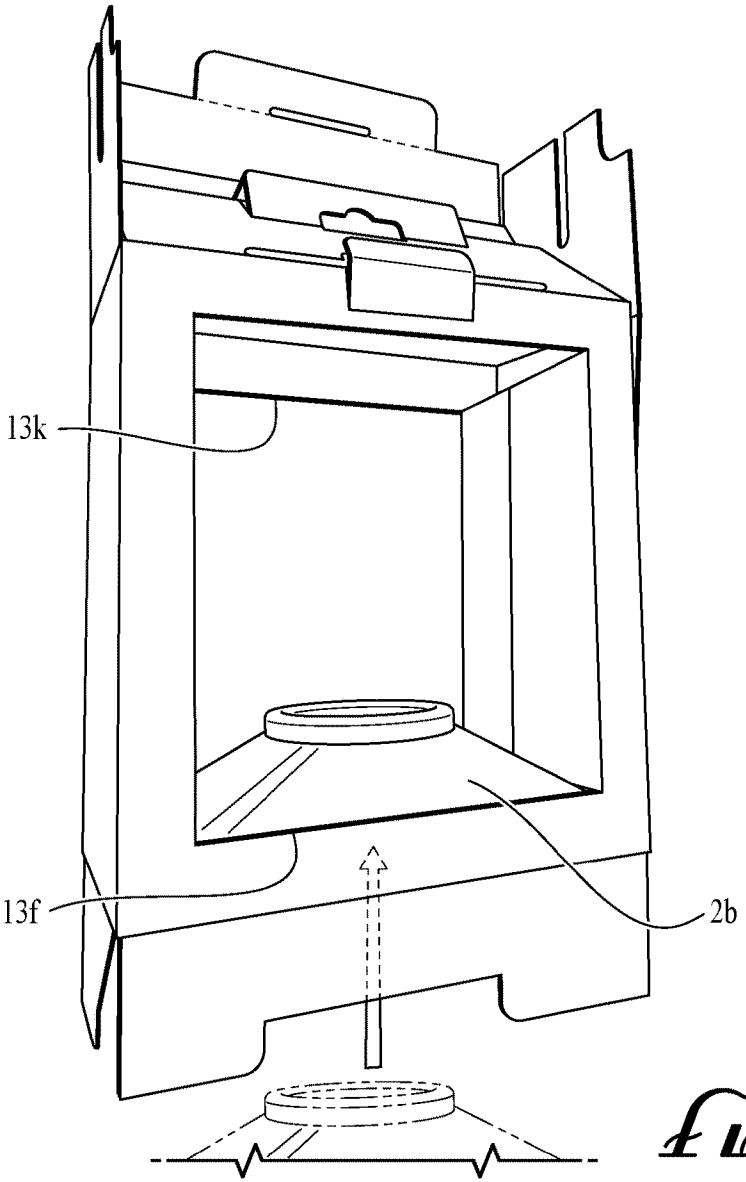
FIG. 4A illustrates a perspective front view of another assembly step of the packaging box wherein a bottom support inserted through the bottom of the packaging box.

FIG. 4A illustrates a process step of forming the packaging box, wherein the bottom support 2 is inserted through the bottom of the box 10 and is positioned within the bottom portion of the side walls in order to provide support for the bottom of a product to be displayed through the windows 13*f* and 13*k*, and further to hold window flaps 13*g*, 13*j*, 13*l*, and 13*o*, as shown in FIG. 4B, in an open configuration to ensure a proper appearance of the windows.

FIG. 4B illustrates another folding process step of the box 10, wherein bottom flaps 12*a*, 12*b*, 12*c*, and 12*d* are folded together to form/close the bottom of the box 10.

Figure 5A:
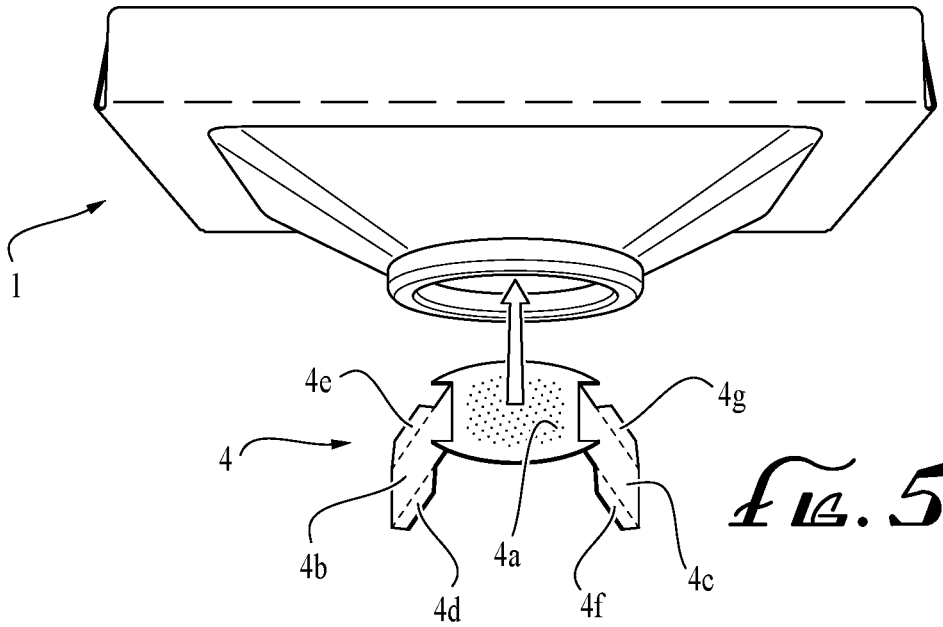
FIG. 5A illustrates another assembly step wherein a product retention bracket is being attached to the support structure.
Figure 5B:
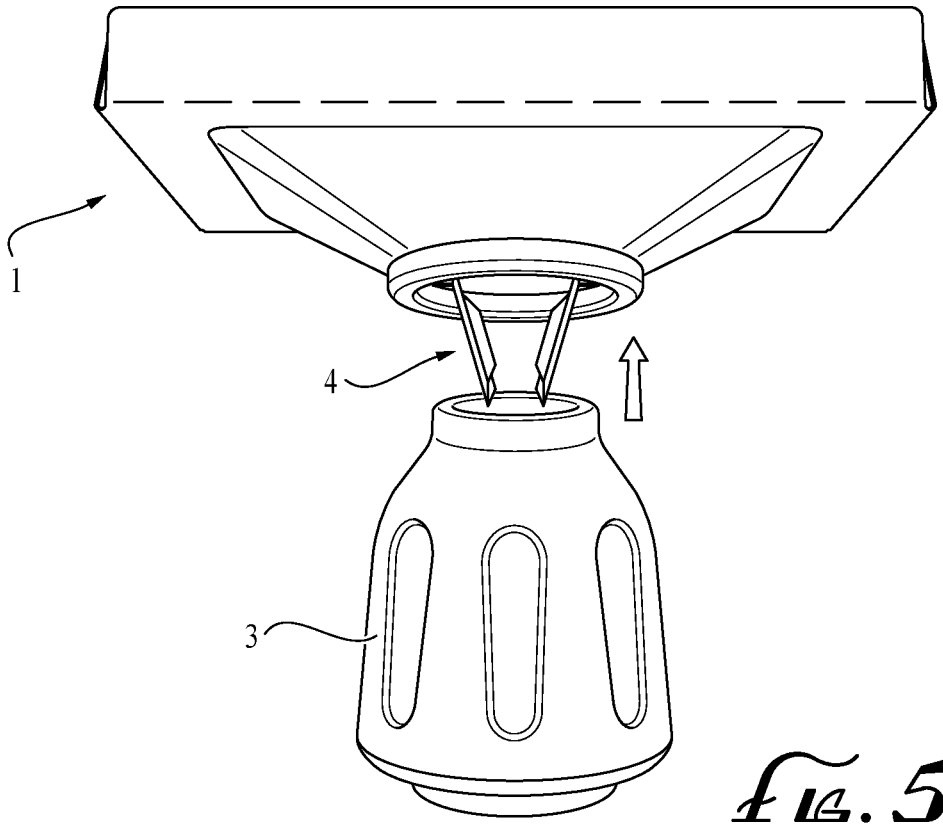
FIG. 5B illustrates another assembly step wherein the product is being attached to the top support structure through the product retention bracket.

As illustrated in FIGS. 5A-5B, the top support may further include a product retention bracket 4. The product retention bracket 4 can be attached to the inner base surface of the ring-shaped portion 1*c* of the top support 1 by various means of attachment, including but not limited to, adhesives, glues, friction-type mechanisms such as a friction-fit design or snap-fit design, etc. The product retention bracket 4 may comprise a base portion 4*a* to be attached to the inner base surface of the ring-shaped portion of the top support 1. Two flaps (4*b*, 4*c*) are attached to one surface of the base portion 4*a*, wherein the two flaps (4*b*, 4*c*) can be attached to the product 3 to allow the product 3 to remain attached to the top support 1 while the top support is being removed from the inside of the box. The two flaps (4*b*, 4*c*) can further include flaps (4*d*, 4*e*, 4*f*, 4*g*) that can be folded relative to flaps (4*b*, 4*c*) to allow the flaps (4*b*, 4*c*) to be inserted into narrower openings provided at the top of the product 3. These flaps (4*d*, 4*e*, 4*f*, 4*g*) in conjunction with flaps (4*b*, 4*c*) may further strengthen the attachment of the product retention bracket 4 to the product.

Figure 5C:
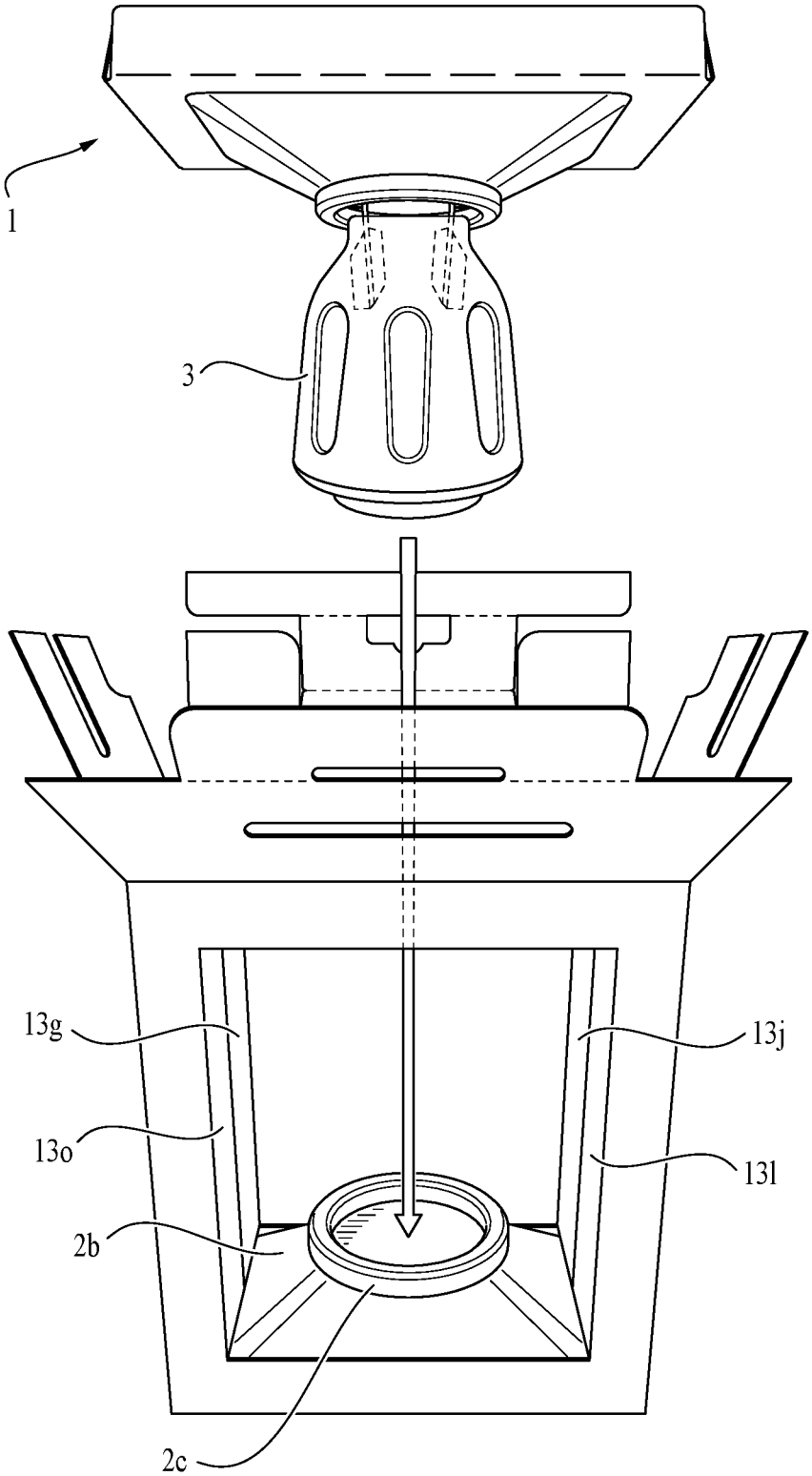
FIG. 5C illustrates a perspective back view of another assembly step wherein the product and the top support structure is inserted through the top of the packaging box.

FIG. 5C illustrates another forming process step of the packaging box, wherein the top support 1 and the attached product 3 are inserted through the top of the box 10 to be placed on the apex 2*c* of the bottom support 2, wherein the product 3 is centered between the apex 2*c* of the bottom support 2 and the apex 1*c* of the top support 1. The top support 1 is positioned within the top portion of the side walls in order to provide support for the top of the product 3 to be displayed through the windows 13*f* and 13*k*, and further to hold window flaps 13*g*, 13*j*, 13*l*, and 13*o* in the open configuration to ensure a proper appearance of the windows.

Figure 6B:
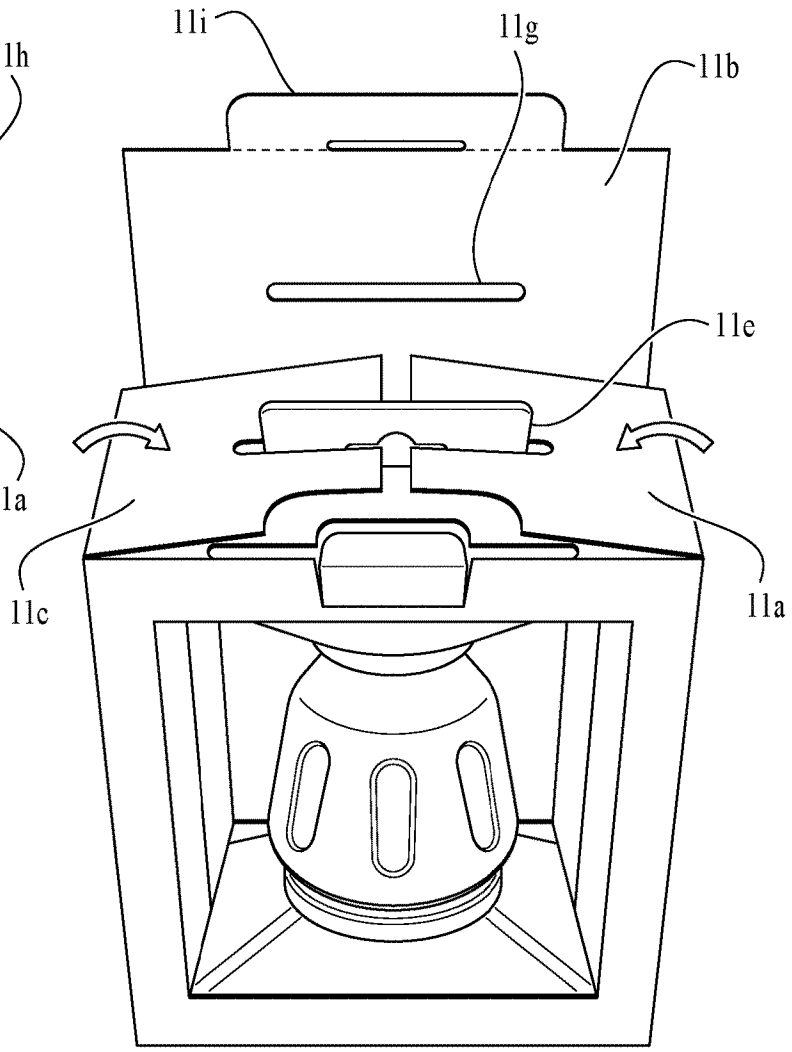
FIGS. 6A-6B illustrate a perspective front view of other assembly steps wherein top flaps are folded to form the top of the packaging box.
Figure 6A:
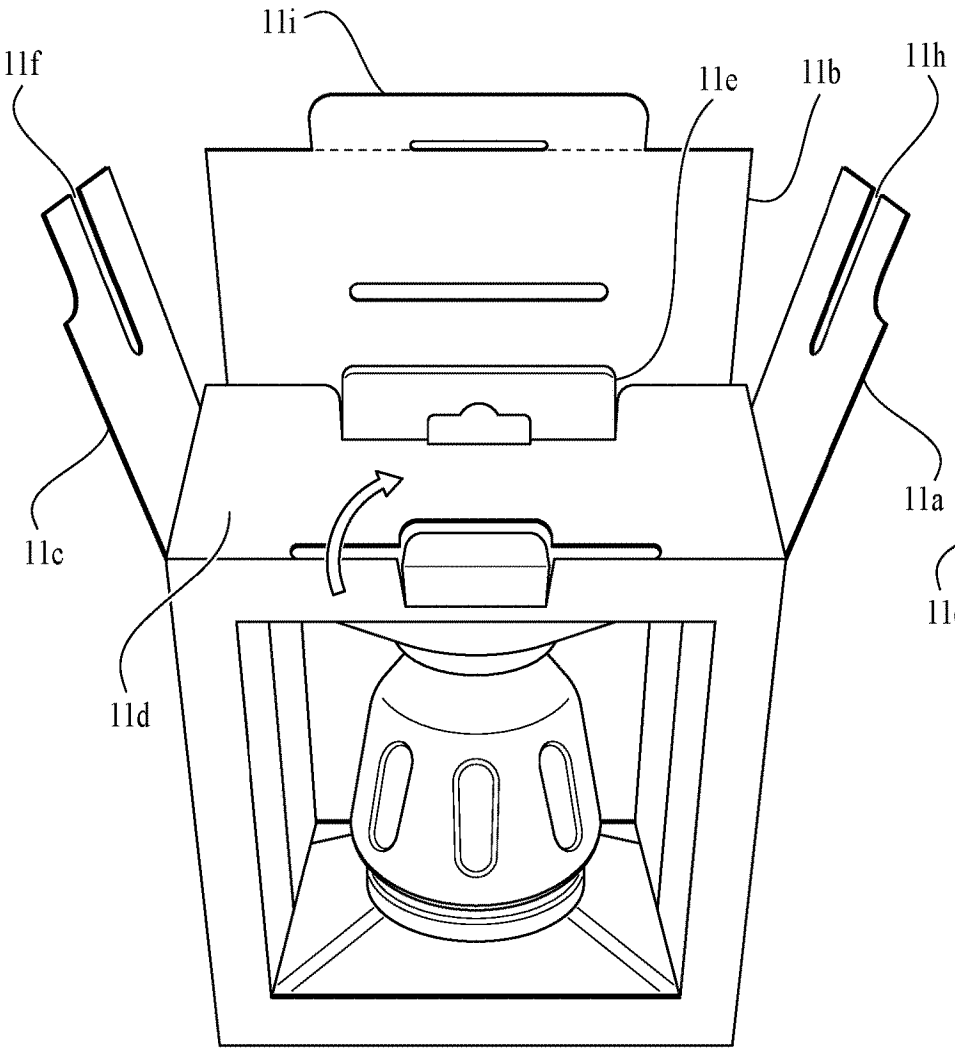

FIG. 6A illustrates another folding process step of the box 10, wherein the handle 11*e* is formed by folding portions 11*o*, 11*p*, and 11*q* over the dashed lines, as shown in FIG. 2, to form the carrying handle 11*e*. FIG. 6A further illustrates wherein the front top flap 11*d* is folded in the direction shown by the arrow to close the top of the box 10 to form a substantially cuboidal shape for the box 10.

FIG. 6B illustrates another folding process step of the box 10, wherein the right top flap 11*a* and the left top flap 11*c* are folded over the front top flap 11*d* as shown by the two arrows, and wherein the projection (first insertion projection) of the carrying handle 11*e* is inserted through the cut-outs 11*f* and 11*h* (as further shown in FIG. 6A) to close/secure the top of the box 10 and provide further strength for the top surface of the box 10.

Figure 7A:
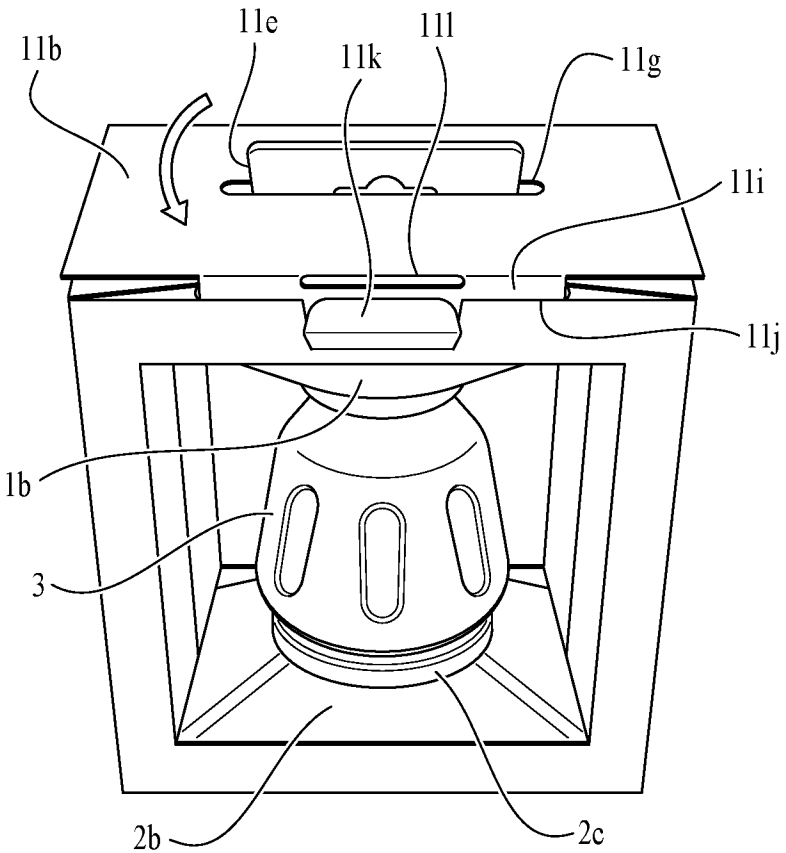

FIG. 7A illustrates another folding process step of the box 10, wherein the back top flap 11*b* is folded over the top of the box 10 as shown by the arrow, and wherein the second insertion projection 11*i* is folded relative to the top flap 11*b* to be inserted through the second cut-out portion 11*j* to further close/secure the top of the box 10. In this step, the back top flap 11*b* is further secured over the carrying handle 11*e* to hold it in place.

FIG. 7B illustrates another folding process step of the box 10, wherein the third insertion projection 11*k* is folded over the corresponding dashed lines (as shown in FIG. 2) and is inserted through the third cut-out portion 11*l* as shown by the arrow to further close/secure the top of the box 10.

As can be understood, the examples described above and illustrated are intended to be exemplary only.

The embodiments described in this document provide non-limiting examples of possible implementations of the present invention. Upon review of the present disclosure, a person of ordinary skill in the art will recognize that changes may be made to the embodiments described herein without departing from the scope of the present invention. Yet further modifications could be implemented by a person of ordinary skill in the art in view of the present disclosure, which modifications would be within the scope of the present invention.

Although the embodiments have been described in detail, it should be understood that various changes, substitutions, and alterations can be made herein without departing from the scope. Moreover, the scope of the present application is not intended to be limited to the particular embodiments of any processes, machines, manufactures, compositions of matter, means, methods and steps described in the specification.

What is claimed is:

1. A packaging box comprising:

a top surface having one or more top flaps;

a bottom surface having one or more bottom flaps;

a side surface having a plurality of side walls;

the plurality of side walls comprise one or more side windows;

the one or more top flaps are folded to form the top surface;

the one or more bottom flaps are folded to form the bottom surface;

the plurality of side walls are folded to form the side surface;

wherein the plurality of side walls connect the top surface to the bottom surface to form an inside of the packaging box;

wherein the plurality of side walls comprise four side walls;

the four side walls comprise a left side wall, a right side wall, a front side wall, and a back side wall;

wherein the top surface comprises four top flaps including a left top flap, a right top flap, a front top flap, and a back top flap, Wherein the left top flap is attached to the left side wall, the right top flap is attached to the right side wall, the front top flap is attached to the front side wall, and the back top flap is attached to the back side wall;

a top support and a bottom support;

wherein the top support is positioned between the four side walls and the top surface;

wherein the bottom support is positioned between the four side walls and the bottom surface;

the top support comprises a first apex and the bottom support comprises a second apex;

wherein the product is placed between the first apex and the second apex;

wherein the inside of the packaging box and the product are visually displayed through the one or more side windows.

2. The packaging box of claim 1, wherein the back top flap comprises a first cut-out portion;

the front top flap comprises a first insertion projection in a form of a carrying handle;

the first cut-out portion receives the first insertion projection.

3. The packaging box of claim 1, wherein the back top flap comprises a second insertion projection that extends from a side of the back top flap;

the front top flap further comprises a second cut-out portion;

the second cut-out portion receives the second insertion projection.

4. The packaging box of claim 1, wherein the front side wall and the front top flap are cut to form a third insertion projection;

the second insertion projection comprises a third cut-out portion;

the third cut-out portion receives the third insertion projection.

5. The packaging box of claim 2, wherein the first insertion projection in the form of the carrying handle comprises a hanger insertion cut-out.

6. The packaging box of claim 1, wherein the one or more side windows comprises a front side window and a back side window;

the front side wall is cut and folded through first predetermined lines to form the front side window;

the back side wall is cut and folded through second predetermined lines to form the back side window.

7. The packaging box of claim 6, wherein the four side walls are rectangular in shape;

the front side window is rectangular in shape and is enclosed within sides of the front side wall;

the back side window is rectangular in shape and is enclosed within sides of the back side wall;

the front side window comprises a first left flap and a first right flap;

the back side window comprises a second left flap and a second right flap;

the first left flap and the first right flap of the front side window are folded toward the inside of the packaging box to form the front side window;

the second left flap and the second right flap of the back side window are folded toward the inside of the packaging box to form the back side window.

8. The packaging box of claim 1, wherein the first apex comprises a first ring shaped portion;

the second apex comprises a second ring shaped portion; and wherein the product is placed between the first ring shaped portion and the second ring shaped portion.

9. The packaging box of claim 1, wherein the top surface, the bottom surface, and the side surface are made from a single sheet of a material, and wherein the single sheet is cut and folded through predetermined lines to form the packaging box.

10. A method of assembling the packaging box of claim 7, comprising:

forming sides of the packaging box by the four side walls to make a square tube;

folding the first left flap and the first right flap of the front side window toward the inside of the packaging box to open the front side window;

folding the second left flap and the second right flap of the back side window toward the inside of the packaging box to open the back side window;

inserting the bottom support through a bottom opening of the packaging box;

folding the one or more bottom flaps to close the bottom opening of the packaging box;

placing the product on the first apex of the bottom support;

inserting the top support through a top opening of the packaging box to display the product being placed between the first apex of the bottom support and the second apex of the top support;

folding the four top flaps to close the top opening of the packaging box.

11. The packaging box of claim 1, further comprising a product retention bracket, the product retention bracket comprises a base portion, a first engaging flap, and a second engaging flap;

the base portion is attached to the first apex of the top support;

the first engaging flap and the second engaging flap are attached to the base portion;

the first engaging flap and the second engaging flap are folded relative to the base portion to be inserted through an opening of the product, thereby, attaching the product to the top support through the product retention bracket;

wherein the top support remains attached to the product while the top support is being removed from the top of the packaging box.

12. A packaging box comprising:

a top surface having four top flaps including a left top flap, a right top flap, a front top flap, and a back top flap;

a bottom surface having one or more bottom flaps;

a side surface comprising four side walls including a left side wall, a right side wall, a front side wall, and a back side wall;

the four side walls comprise one or more side windows;

the four top flaps are folded to form the top surface;

the one or more bottom flaps are folded to form the bottom surface;

the four side walls are folded to form the side surface;

the four side walls connect the top surface to the bottom surface to form an inside of the packaging box;

wherein the left top flap is attached to the left side wall, the right top flap is attached to the right side wall, the front top flap is attached to the front side wall, and the back top flap is attached to the back side wall;

the packaging box further comprising atop support with a first apex, and a bottom support with a second apex;

a product positioned between the top support and the bottom support;

wherein the top support is positioned between the four side walls and the top surface;

wherein the bottom support is positioned between the four side walls and the bottom surface; and wherein the product is visually displayed through the one or more side windows while positioned between the first apex and the second apex.

13. The packaging box of claim 12, wherein the back top flap comprises a first cut-out portion;

the front top flap comprises a first insertion projection in a form of a carrying handle; and the first cut-out portion receives the first insertion projection.

14. The packaging box of claim 13, wherein the back top flap comprises a second insertion projection that extends from a side of the back top flap;

the front top flap further comprises a second cut-out portion; and the second cut-out portion receives the second insertion projection.

15. The packaging box of claim 14, wherein the front side wall and the front top flap are cut to form a third insertion projection;

the second insertion projection comprises a third cut-out portion; and the third cut-out portion receives the third insertion projection.

16. The packaging box of claim 12, wherein the one or more side windows comprises a front side window and a back side window;

the front side wall is cut and folded through first predetermined lines to form the front side window; and the back side wall is cut and folded through second predetermined lines to form the back side window.

17. The packaging box of claim 16, wherein the first apex comprises a first ring shaped portion;

the second apex comprises a second ring shaped portion; and wherein the product is placed between the first ring shaped portion and the second ring shaped portion;

the packaging box further comprises a product retention bracket, the product retention bracket comprises a base portion, a first engaging flap, and a second engaging flap;

the base portion is attached to the first apex of the top support;

the first engaging flap and the second engaging flap are attached to the base portion;

the first engaging flap and the second engaging flap are folded relative to the base portion to be inserted through an opening of the product, thereby, attaching the product to the top support through the product retention bracket; and wherein the top support remains attached to the product while the top support is being removed from the top of the packaging box.

* * * * *